United States Patent [19]

Riedel

[11] 4,310,951

[45] Jan. 19, 1982

[54] LEVER-OPERABLE FASTENER FOR SHOES

[75] Inventor: Tilo H. Riedel, Salzburg, Austria

[73] Assignee: Sesamat Anstalt, Schaan, Liechtenstein

[21] Appl. No.: 91,985

[22] Filed: Nov. 7, 1979

[30] Foreign Application Priority Data

Nov. 7, 1978 [AT] Austria ..... 7943/78

[51] Int. Cl.[3] ..... A43C 11/00

[52] U.S. Cl. ..... 24/68 SK; 24/70 SK; 36/50

[58] Field of Search ..... 24/68 R, 68 SK, 69 R, 24/69 SK, 69 ST, 70 R, 70 SK, 71 R, 71 SK; 36/50

[56] References Cited

U.S. PATENT DOCUMENTS

| | | | |
|---|---|---|---|
| 376,055 | 1/1888 | Hopkins et al. | 24/68 SK |
| 3,292,222 | 12/1966 | Steinberg | 24/68 SK |
| 3,662,435 | 5/1972 | Allsop | 24/70 SK |
| 4,112,557 | 9/1978 | Salomon | 24/70 SK X |
| 4,299,862 | 10/1980 | Kubelka | 24/68 SK |

FOREIGN PATENT DOCUMENTS

| | | | |
|---|---|---|---|
| 1340134 | 9/1963 | France | 24/70 SK |

*Primary Examiner*—Thomas J. Holko
*Attorney, Agent, or Firm*—Kurt Kelman

[57] ABSTRACT

The fastener comprises two fastener members, one of which consists of a tension strap and the other of a strap retainer. One of the fastener members is provided with teeth, which are interengageable with a tensioning lever, which is associated with the other fastener member. Strap-restraining means are also provided, which comprise a locking pawl that is mounted on said other fastener member and cooperates with said teeth.

The teeth have inclined tooth spaces and in order to facilitate the operation of the fastener are provided either on the tension strap on its inner side facing the shoe or on the strap retainer on its outer side facing away from the shoe. That part of the strap-restraining means which cooperates with the tension strap extends away from the shoe and is firmly connected to the strap retainer.

24 Claims, 13 Drawing Figures

LEVER-OPERABLE FASTENER FOR SHOES

This invention relates to a lever-operable fastener for a shoe, particularly for a skiing boot, comprising two fastener members, which consist of a tension strap and a strap retainer and are attached to respective shoe parts to be joined by the fastener. One of said fastener members comprises a series of teeth, which are engageable by a tensioning lever, which is associated with the other fastener member. The fastener also comprises ratchet-like strap-restraining means, which comprise a locking pawl, which is provided on said other fastener member and cooperates with said teeth.

A known lever-operable fastener of that kind has been disclosed in U.S. Pat. No. 3,662,435 and comprises a strap retainer consisting of a U-shaped bearing bracket, in which an actuating lever is pivotally mounted. In one embodiment, the journals of said actuating lever are guided in oblique slots so that the tensioning lever can perform translational as well as pivotal movements. This is necessary because the actuating lever at its end adjacent to the bearings constitutes a pinion, which cooperates with the teeth of the tension strap; those teeth face away from the shoe. The tension strap must be threaded into the strap retainer between the crosspiece of the bearing bracket and the pinion and for that operation the pinion must be disengaged from the teeth of the strap. The actuating lever can be moved in the slots of the bearing bracket in order to disengage the pinion from the teeth. Thereafter the strap is tensioned in that the actuating lever is forced to its operative position, in which it cooperates with the tension strap, and a suitable pivotal movement is then imparted to the actuating lever so that the desired tension is exerted on the pulling strap by means of the pinion. A locking pawl is provided for restraining the tension strap and is pivoted in the bearing bracket of the strap retainer and can be forced between teeth of the tension strap. That design has the disadvantage that the tension strap must be threaded into the strap retainer. Such threading is an inconvenient operation particularly during cold weather when gloves are worn. Because the teeth are straight, the actuating lever, which serves as a tensioning lever, must be pulled from the teeth of the tension strap when the tensioning operation has been performed. In that case the locking pawl must be actuated by hand to ensure that the tension imparted to the strap is not lost. Finally, when the strap is to be tensioned, the actuating lever must be actuated in a sense which is opposite to the sense of actuation of the conventional buckles of skiing boots; this is also regarded as a disadvantage because it is not sufficient to depress the actuating lever but the latter must be pulled up too. This pulling-up involves an inconvenient additional restoring of the actuating lever after the tensioning operation.

For these reasons, the known lever-operable fastener described above has been improved so that the actuating lever can be depressed in the usual manner for tensioning the tension strap. This is permitted in that the actuating lever is only rotatably mounted in the bearing bracket, a detent element is pivoted to the actuating lever and said detent element is provided at its free end with teeth which protrude toward the teeth of the tension strap. The teeth of the detent element and those of the tension strap have oblique faces on one side. As the actuating lever is depressed, the detent element is advanced and owing to the meshing teeth the tension strap is caused to follow said movement. When the actuating lever is retracted, the oblique side faces of the teeth permit the detent element to slide back. Owing to this feature the tension strap can be tensioned by a ratchet-like mechanism. In said ratchet mechanism, a locking pawl is required, which cooperates with the teeth of the tension strap like the detent element of the actuating lever. Said locking pawl is pivoted in the bearing bracket and restrains the tension strap as the actuating lever is pulled up from the shoe. During the subsequent tensioning operation, the detent element which is pivoted to the actuating lever interengages with the teeth of the tension strap and advances the latter in the closing sense whereas the locking pawl is slipping. That modified design has also the disadvantage that the tension strap must be threaded into the strap retainer and cannot be simply inserted into the strap retainer from above. The known lever-operable fasteners described hereinbefore are structurally expensive and require bias springs for the detent element of the actuating lever and for the locking pawl. Such springs may break. Because the tension strap must be threaded into the strap retainer and is engaged by spring-biased elements, the fastener must be movable to predetermined positions in which the ratchetlike engagement between the tension strap, on the one hand, and the detent element or the locking pawl, on the other hand, is eliminated so that the tension strap can be removed from the strap retainer.

It is an object of the invention to eliminate these disadvantages and to provide a lever-operable fastener which is of the kind described first hereinbefore and which is improved in that the fastener involves only a low structural expenditure and can be actuated in a simple manner.

This object is accomplished in that the teeth are provided either on that side of the tension strap which faces the shoe or on that side of the strap retainer which faces away from the shoe, said teeth define tooth spaces which are inclined from a normal on the tension strap, and that part of the strap-restraining means which cooperates with the tension strap is fixed to the strap retainer and extends away from the shoe.

One difference between the novel fastener and the prior art resides in that the teeth are provided on that side of the tension strap which faces the shoe or on that side of the strap retainer which faces away from the shoe. For this reason the tension strap need no longer be threaded into the strap retainer but can be inserted into the strap retainer from above. In one case, the detent element which is pivoted to the strap retainer enters the spaces between the teeth provided on that side of the tension strap which faces the shoe. In the other case, the detent element is pivoted to the tension strap and is inserted between the teeth provided on that side of the strap retainer which faces away from the shoe. In both cases the tension imparted to the tension strap tends to force the detent element between the teeth so that there is no need for a separated bias spring. With a view to these force actions, the tooth spaces are inclined from a normal on the tension strap so that the detent element will be firmly forced into the tooth spaces. These advantages are afforded also as far as the strap-restraining means are concerned because that part thereof which cooperates with the tension strap is fixed to the strap retainer and extends away from the shoe. It will be understood that that part of the strap-restraining means which is carried by the tension strap must face the part that is carried by the strap retainer and is also forced by the tension of the tension strap against the strap retainer and that part of the strap-restraining mechanism which is carried by the strap retainer. The slipping of the strap-restraining means and of the detent element during the tensioning of the fastener is permitted because the tension strap is movable so that it can give way or yield. It is seen that the arrangement of the teeth and of the strap-restraining means in accordance with the invention results in a very simple structure in which no bias springs are required and which permits of a simple insertion of the tension strap from above and a simple release of the fastener because this can be accomplished simply in that the tension strap is lifted out of the strap retainer away from the shoe.

If the detent element engages the strap retainer and the tension strap in the closed position of the fastener at points spaced apart in a direction which is at right angles to the longitudinal direction of the tension strap and the distance between said points is selected so that the detent element is then held in an overcenter position, there will be no need for separate means holding the fastener in its closed position because any increase of the tension of the tension strap will result in a stronger retaining force exerted on the detent element. The detent element serves also as a tensioning lever and according to another feature of the invention can be held in an overcenter position in that the fastener is held in its closed position by restraining projections, which cooperates with the tension strap and the detent element. Instead of restraining projections, it is possible to provide suitable restraining recesses for the same purpose. These restraining projections or recesses restrain the detent element and the tension strap against any transverse forces which might otherwise impart to the detent element or the tension strap a pivotal movement away from the strap retainer. On the other hand, when it is desired to open the fastener, the tension strap can be released in a simple manner by the application of a force which is sufficient to overcome the resistance presented by the restraining projections or recesses.

If the strap retainer comprises in known manner a channel-shaped bearing bracket, which has side walls for guiding the tension strap, and the detent element consists of a tensioning lever and is pivoted in said bracket, a particularly simple structure can be provided in accordance with a feature of the invention in that the detent element consists of a U-shaped member, which has legs having angled end portions that are rotatably held in the bearing bracket whereas the crosspiece of the U-shaped detent element interenages with the teeth on that side of the tension strap which faces the shoe. As soon as the tension strap has been inserted from above into the strap retainer, the crosspiece of the U-shaped detent element is forced into one of the tooth spaces so that the tension strap is carried along as a pivotal movement is imparted to the detent element. The tooth spaces have such an orientation that the detent element can leave the tooth spaces under the action of the tension of the tension strap. As the U-shaped detent element is swung up, the tension strap is forced away from the U-shaped detent element so that the crosspiece of the detent element leaves the tooth space and in dependence on the extent of the angular movement subsequently enters another tooth space so that the detent element is forced down once more so as to tension the strap. As the detent element is swung up, the tension of the tension strap causes the latter to be pulled into the strap-restraining means so that the latter prevent a decrease of the tension previously imparted to the strap.

In another embodiment of the invention, the strap retainer consist of a channel member, the legs of which extend away from the shoe and carry the teeth, and the detent element is rotatably mounted in the tension strap and has two legs, which are disposed laterally of the tension strap and protrude toward the teeth and have a detent projection for entering a desired tooth space. That modification produces similar results. But as the strap or the detent element is swung up another strap-tensioning operation, the detent element slips over the teeth of the strap retainer. When the detent sense, the detent snaps into another tooth space which is more remote from that part of the shoe which carries the tension strap. In such an arrangement the structure can be simplified in that the restraining projections or recesses are formed on or in the crosspiece of a U-shaped detent element, which has angled leg ends that are mounted in the tension strap. In that case the tension strap must extend over the crosspiece of the U-shaped detent element.

To ensure that the detent element will always snap into tooth spaces during the swingback which precedes the tensioning of the tension strap, a further feature of the invention resides in that a stop is provided, which limits the pivotal movement of the detent element in the opening sense and defines for the detent element an optimum initial position for the subsequent tensioning operation. It will be desirable to subject the detent element to a spring bias in the opening sense because this will ensure that the detent member will move to the initial position defined by the stop. A separate spring may be used but is not required for that spring bias. In a simple arrangement, the U-shaped detent element is resilient and its leg ends include an obtuse angle with each other and preferably extend into slots formed in the bearing bracket or tension strap. These slots provide space for the leg ends, which are resiliently deflected as the U-shaped detent element is swung and said legs then exert a spring force which ensures the return of the U-shaped detent element when it has been released. Said slots may serve also as a stop which defines the end position of the U-shaped detent element. The slots may be replaced by conically flaring holes.

The exertion of a force for restoring the detent element to its initial position without need for separate springs may be ensured in that the bearing bracket or the tension strap has beveled outside surfaces for engaging the resilient legs of the detent element. The resilient legs of the detent elements are spread apart by the engaging surfaces as the detent element is pivotally moved in a tensioning sense and cause the detent element to be returned when it has been released.

To ensure a simple operation of the lever-operable fastener, a further feature of the invention resides in that the free end portion of the tension strap is reinforced and serves as an actuating lever. In that modification, it will be sufficient to swing the tension strap forth and back in order to increase the tension of the strap. Instead of the tension strap, the detent element may be used as an actuating lever, particularly when it extends beyond its point of engagement with the tension strap to form an actuating lever. Such a design results in mechanical advantages which permit an actuation with a small effort.

The strap-restraining means associated with the tension strap may be provided in various forms. In a particularly simple design, the locking pawl of the strap-restraining means consists of a rib formed on the crosspiece of the strap retainer, which is channel-shaped and has preferably resilient side walls, which adjacent to the locking pawl carry guiding projections, which protrude toward the tension strap on a level which is selected with a view to the thickness of the tension strap. As the strap is tensioned by the detent element, which acts as a tensioning lever, the tension of the tension strap causes the latter to be forced between the guiding projections against the locking pawl, which consists of the rib on the crosspiece and which then engages the teeth on the tension strap and prevents an unintended loosening of the latter. As the detent element is swung back in preparation for a tensioning of the strap, the latter should not be forced away from the rib of the crosspiece. This is prevented by the guiding projections, which protrude toward the strap and are preferably disposed before or behind the locking pawl so that the strap can give way as it slides over the locking pawl during the tensioning operation. The tensile force exerted on the strap as it is tensioned ensures that these strap-restraining means will act like a ratchet in that the teeth on the strap slide over the locking pawl. The resilient side walls of the strap retainer permit the tension strap to enter the strap retainer between the guiding projections and also to separate from the strap retainer. The same result could also be produced by the use of a tension strap which is laterally resilient and for this purpose has apertures adjacent to the strap-restraining means.

The insertion of the tension strap into the strap retainer may be facilitated if the tension strap is laterally provided with grooves, which conform to the guiding projections in cross-section and have longitudinal axes which are inclined in a sense which is opposite to the inclination of the tooth spaces. In this embodiment the guiding projections enter the grooves as the strap is tensioned so that the guiding action of the grooves causes the tension strap to be forcibly pulled inwardly past the guiding projections.

The locking pawl of the strap-restraining means need not be provided on the strap retrainer but may alternatively be provided on the tension strap and may consist of lateral projections, which extend into teeth provided on the side walls of the strap retainer so that said projections slip over the teeth on the strap retainer from tooth space to tooth space as the strap is tensioned.

Because the tension strap is connected to the detent element, the tension strap is carried along during the pivotal movement of the detent element through a certain angle. On the other hand, the tension strap is retained on the strap retainer by the locking pawl so that said movement of the tension strap in unison with the detent element may give rise to difficulties under extreme temperature conditions if certain materials have been used to make the strap. Besides, the strap material may exhibit fatigue in the portion in which it is bent. This can be prevented in that the detent element which serves as a tensioning lever is linked to the tension strap by a U-shaped link, as in a tightener-operable fastener. Because the detent element is not directly hinged to the tension strap but is linked to the latter by a U-shaped element, the operation of the detent element serving as a tensioning lever imparts a pivotal movement to the U-shaped member rather than to the tension strap so that the flexibility of the latter is no longer critical. Besides, the U-shaped link defines the pivotal axes so that the conditions existing during the operation of the fastener will be clearly defined and the tension strap will not be subjected to cyclic bending stress.

If the U-shaped link is pivoted to the tension strap at a distance from the free end of the tension strap, at which end the strap carries the locking pawl, it will be possible to provide the locking pawl and that portion of the detent element which engages the teeth of the strap retainer very close to each other so that a large part of the length of the series of teeth can be used for the tensioning operation. Besides, during the tensioning operation effected by the detent element, the locking pawl will be relieved from the tension of the strap because the entire tension must be taken up by the U-shaped link. As a result, the strap can slip more easily through the strap-restraining means.

The operation of the fastener can be further simplified if the relative angular movement of the U-shaped link and the detent element is limited by a stop at least in the sense of the opening movement of the detent element. Such a limitation of the angular movement ensures that the tension of the strap can be increased only in steps. This results in a very desirable mechanical advantage.

The subject matter of the invention is illustrated by way of example on the drawings, in which FIGS. 1 to 3 are side elevations, partly torn open, and show a lever-operable fastener according to the invention in three different tensioned positions;

Figure 1:
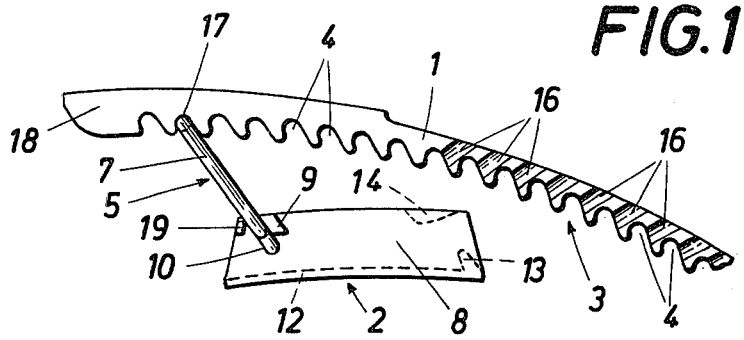
Figure 2:
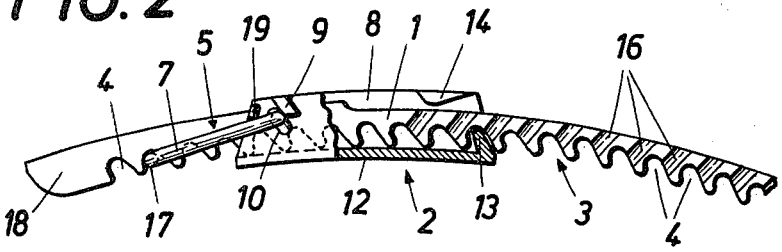
Figure 3:
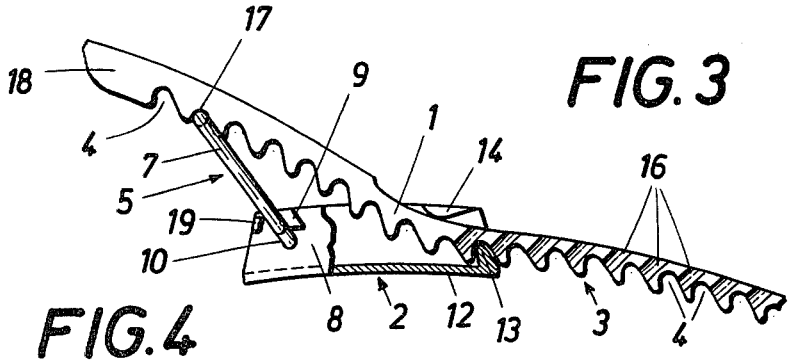
Figure 5:
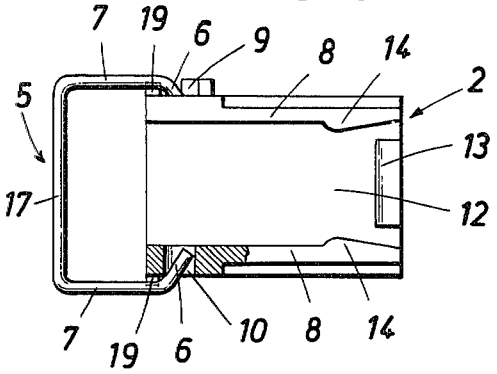
FIG. 5 is a top plan view showing a strap retainer.
Figure 6:
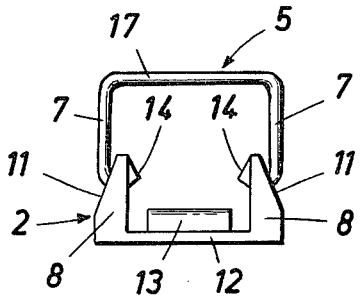
FIG. 6 is an end elevation showing a modified step retainer.

The lever-operable fastener according to FIGS. 1 to 3 comprises a tension strap 1, which is attached to one part of the shoe, not shown, and a strap retainer 2 attached to another part of the shoe. On its inner side, facing the shoe, the tension strap 1 is provided with teeth 3, which define tooth spaces 4, which are inclined from a normal on the tension strap. The strap retainer consists of a channel-shaped bearing bracket, in which a detent element 5 is pivoted, which serves as a tensioning lever and cooperates with the teeth 3 of the tension strap 1. The detent element consists of a U-shaped member, the legs 7 of which have angled end portions 6 (FIG. 5), which are rotatably held in side walls 8 of the bearing bracket. The side walls 8 of the bearing bracket serve also to guide the tension strap 1 at its side edges. The extent to which the detent element 5 can be moved in the opening sense is limited by a stop 9, which is carried by the side walls 8 and extends toward the legs 7 of the detent element 5. As is particularly apparent from FIG. 5, the leg ends 6 of the resilient U-shaped member include an obtuse angle with each other and extend into slots 10 in the side walls of the strap retainer 2. As a result, the inherent resiliency of the detent element 5 is used to return it to its initial position for the tensioning operation; that position is shown in FIGS. 1 and 3. In accordance with FIG. 6, the same result could be produced by the provision of a beveled outside surface 11 on each side wall 8 of the strap retainer 2. During the pivotal movement of the U-shaped detent element, the legs 7 of the latter are spread apart as they engage the surfaces 11 so that the inherent resiliency of the legs 7 will cause the detent element 5 to be returned when it has been released.

Figure 4:
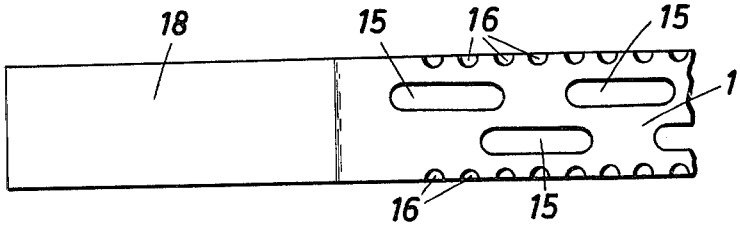
FIG. 4 is a top plan view showing an apertured tension strap.

The crosspiece 12 of the strap retainer 2 is formed with a rib 13 at that end of the strap retainer 2 which faces the tension strap 1. The rib 13 faces outwardly, i.e., away from the shoe and cooperates with the teeth 3 of the tension strip 1 to provide means which restrain the tension strap 1 against being pulled back. Said rib 13 thus constitutes a locking pawl. Adjacent to the rib 13, the side walls 8 of the strap retainer 2 carry guiding projections 14, which protrude toward the tension strap 1 and are disposed above the locking pawl 13 by a height which exceeds the thickness of the tension strap. These projections 4 serve to prevent an inadvertent lifting of the tension strap 1 from the locking pawl 13. The guiding projections have bevelled surfaces (see FIG. 6), which permit the tension strap 1 to be inserted past the guiding projections 4 into the strap retainer 2. The side walls 8 of the strap retainer 2 are resilient so that they can yield the tension strap 1 is forced into the strap retainer 2. Alternatively, the tension strap 1 may be formed with apertures 15 (FIG. 4), so that it is laterally resilient.

If the tension strap is formed in its side edges with grooves 16, which conform in cross-section to the guiding projections 14 and, as is clearly apparent from FIG. 1, are inclined from a normal on the tension strap in a sense which is opposite to the inclination of the tooth spaces 4, the tension strap 1 will be reliably forced against the rib 13 as the fastener is tensioned.

It is shown in FIG. 1 that the teeth 3 of the tension strap 1 have been engaged with the crosspiece 17 of the detent element 5 so that the cross-piece 17 has entered a tooth space 4. When an actuating lever 18 consisting of a stiffened end portion of the tension strap 1 is then depressed, the tension strap 1 can be tensioned to a certain degree because the depression of the actuating lever 18 causes the detent element 5 to be swung to the position shown in FIG. 2 and the tension strap 1 is then carried along in the closing sense by the detent element 5. In this operation that portion of the tension strap which is provided with the grooves 16 slides through between the guiding projections 14 into the strap retainer 2 until the teeth 3 of the strap 1 cooperate with the rib 13. The latter will not obstruct the tensioning of the strap 1 because the tooth spaces 4 have such an inclination that the teeth 3 can slide over the correspondingly inclined rib. For this purpose, the guiding projections 14 succeed the rib 13 so that the strap 1 can give way. When the tension strap 1 is then swung up by means of the actuating lever 18, the tension which has previously been imparted to the strap 1 pulls the latter firmly against the rib 13 so that the strap 1 cannot be lifted from the rib 13 and the tension strap 1 is thus restrained against being pulled back. On the other hand, as the actuating lever 18 is swung up, the crosspiece 17 of the detent element 5 leaves the tooth space 4 and owing to its spring bias is forced upwardly too. Now the crosspiece 17 slides over the teeth until it has reached its open position, defined by the stop 9. When the actuating lever 18 is then forced down once more, the detent element 5 firmly snaps into a new tooth space and the tension stress can be tensioned further without a need to loosen it before. When the detent element 5 is in the position shown in FIG. 2 at the end of the tensioning operation, the points at which the detent element engages the strap retainer and the tension strap are spaced such a distance apart in a direction at right angles to the longitudinal direction of the tension strap that the detent element 5 is then in an overcenter position. The detent element can be restrained in that overcenter position by means of restraining projection 19, past which the detent element must be forced to its overcenter position.

When it is desired to open the fastener, it is sufficient to pull up the actuating lever 18 to such an extent that the tension strap 1 is moved out of the strap retainer 2 past the guiding projections 14. The use of a stiffened strap end portion which constitutes an actuating lever 18 does not only facilitate the operation of the fastener but in a desirable manner ensures that the strap will be deflected at the joint from the stiffened portion to the normal strap. This features improves the reliability in function.

Figure 7:
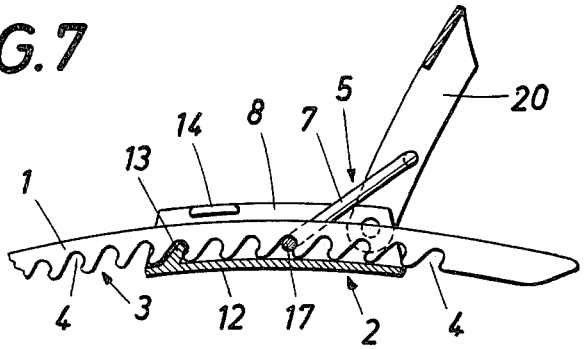
FIG. 7 is a sectional view showing a lever-operable fastener in which the detent element is pivoted to an additional actuating lever.

The fastener shown in FIG. 7 is not operated by a stiffened end portion of the tension strap 1 but by a separate actuating lever 20, which is pivoted to the walls 8 of the strap retainer 8. The detent element 5 is pivoted to the actuating lever 20 and has a crosspiece 17, which enters the tooth spaces 4 of the strap 1.

Figure 8:
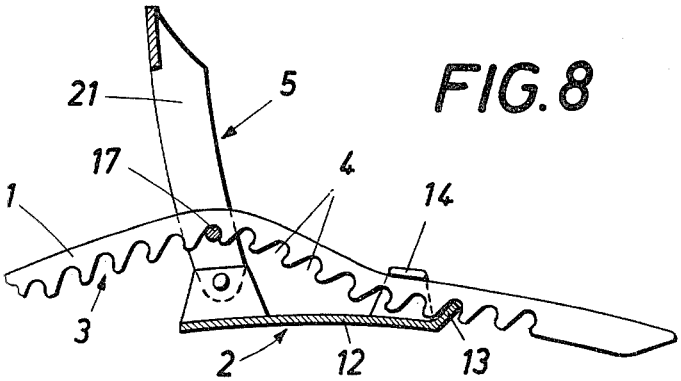
FIG. 8 is a view similar to FIG. 8 and shows another modification of a lever-operable fastener according to the invention.

In the embodiment shown in FIG. 8, the strap retainer 2 has no continuous side walls 8 and the detent element 5 extends beyond the crosspiece 17 to form an actuating lever 21 so that there is no need for an additional actuating lever.

Figure 9:
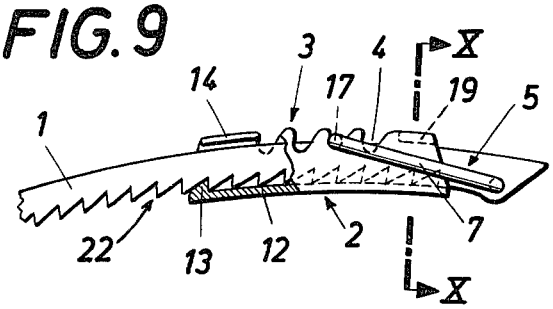
FIG. 9 is a side elevation, partly torn open, and shows a lever-operable fastener having a detent element which is mounted in the tension strap.
Figure 10:
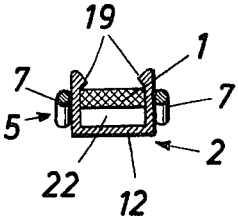
FIG. 10 is a sectional view taken on line X—X of FIG. 9
Figure 11:
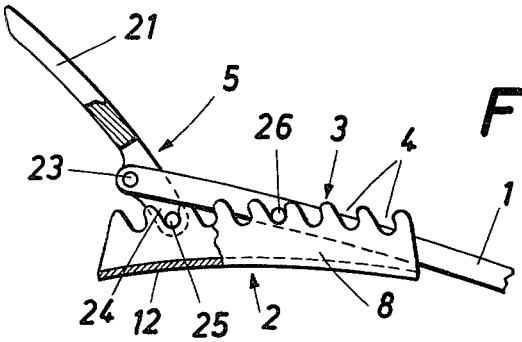
FIG. 11 is a side elevation, partly in section, showing a lever-operable fastener in which the locking pawl of the strap-restraining means is carried by the tension strap.

In the embodiments shown in FIGS. 9 to 11, the teeth 3 are carried by the strap retainer 2 rather than by the tension strap 1. In this case the teeth 3 face outwardly, away from the shoe, so that the tension strap 1 can easily be inserted into the strap retainer 2 from above. In this modification, the detent element 5 is pivoted to the tension strap 1. The function of the fastener is the same. The embodiment shown in FIG. 9 differs from that of FIG. 11 in that the tension strap 1 is provided with separate teeth 22 for cooperating with the locking pawl 13 of the strap-restraining means. The restraining projections 19 provided to hold the fastener in its closed position act directly on the tension strap 1 rather than on the detent element 5; this action produces similar results.

In the embodiment shown in FIG. 11, the detent element 5 is extended beyond the point 23 where it engages with the tension strap 1 and this extension constitutes an actuating lever 21. The detent element 5 has legs 24, which protrude toward the teeth 3 and are provided with detent projections 25, which can enter the tooth spaces. The locking pawl of the strap-restraining means consists of lateral projections which are carried by the tension strap and interengage with the teeth 3 of the strap retainer 2. As the strap 1 is tensioned by means of the actuating lever 21, the projections 26 slip from one tooth space into the next.

Figure 12:
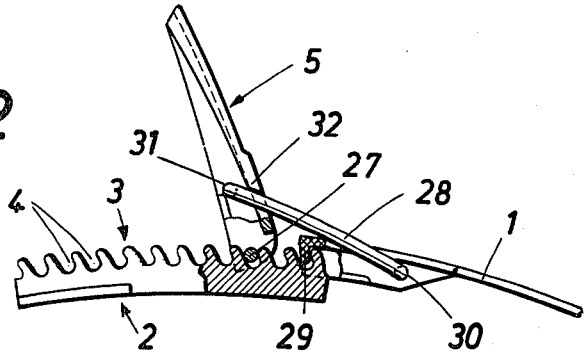
FIG. 12 is a side elevation, partly torn open, and shows a lever-operable fastener according to the invention in which the detent element is linked to the tension strap by a U-shaped link, as in a tightener-operable fastener.
Figure 13:
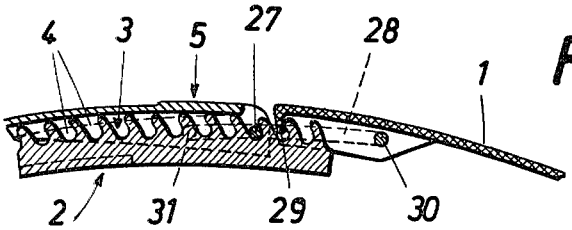
FIG. 13 is a longitudinal sectional view showing the lever-operable fastener of FIG. 12 in closed position.

In the embodiment shown in FIGS. 12 and 13, the detent element 5 used as a tensioning lever comprises a pivot portion 27, which extends into tooth spaces 4 of the teeth 3. By means of a U-shaped link 28, the detent element 5 is linked to the tension strap 1 as in a tightener-operable fastener. A locking pawl 29 is constituted by an extension, which is carried by the tension strap at its free end, which faces the detent element. The pivotal axes 30 and 31 of the U-shaped link 28 are spaced apart from the extension 29.

When the detent element 5 has been placed on the strap retainer 2 and the detent element used as a tensioning lever is moved from the position shown in FIG. 12 to the position shown in FIG. 13, the tension strap 1 is pulled by means of the U-shaped link 28. In this operation, the extension 29 slips from tooth space to tooth space. If the resulting strap tension is inadequate, it will be sufficient to swing up and force down the detent element 5 in order to increase the strap tension. As the detent element 5 is swung up, its portion 27 is forced out of the tooth space 4 in which it had been received because the extension 29 serves as a locking pawl, which prevents the tension strap 1 from being pulled back so that the U-shaped link 28 can move about a fixed pivotal axis 30. The pivotal movement of the detent element 5 relative to the U-shaped link 28 is desirably limited by a stop 32 so that the tension increase which can be effected by each tensioning movement is restricted.

In its closed position this lever-operable fastener is in an overcenter position, which is determined by the locations of the pivotal axes 30 and 31 and of the part 27. An additional safety can be provided by the provision of inherently elastic or spring-loaded projections, which restrain the detent element 5 and/or the U-shaped member 7 in the closed position by presenting a resistance which can be overcome only by a predetermined effort.

It will be understood that the invention is not restricted to the embodiments shown by way of example. For instance, the strap-restraining means may be provided in various forms. Instead of ratchetlike strap-restraining means provided with teeth, strap-restraining means may be used which comprise a clamping wedge, which cooperates with a suitable wedge-shaped groove when the strap is inserted from above into the strap retainer. It is essential only that that part of the strap-restraining means which cooperates with the tension strap extends outwardly, away from the shoe, so that the tension strap can be inserted into the strap retainer from above.

What is claimed is:

1. A lever-operable fastener for a shoe, comprising a first fastener member comprising a tension strap and adapted to be attached to one part of a shoe, a second fastener member comprising an outwardly open strap retainer adapted to be attached to another part of a shoe and to receive said tension strap in a predetermined orientation, at least one series of teeth carried by one of said fastener members on the side thereof which faces the other one of said fastener members in said orientation, said one series of teeth defining tooth spaces which are inclined from a normal on said said strap when said strap has been received by said retainer in said orientation, a tensioning lever which is connected to said other fastener member and pivotally movable relative thereto in one sense to enter said tooth spaces and engage said one series of teeth and then to tension said strap in its longitudinal direction, and in the opposite sense to disengage said one series of teeth and leave said tooth spaces to release said strap, and strap-restraining means comprising a first part comprising said series of teeth and a second part comprising a locking pawl carried by said other fastener member and adapted to hold said strap in tension when said strap has been received by said retainer and tensioned and subsequently released by said tensioning lever, one of said parts of said strap-restraining means being fixed to said retainer and extending toward and being adapted to cooperate with said strap.

2. A fastener as set forth in claim 1, in which said one series of teeth are carried by said strap and disposed on the side thereof which faces said retainer.

3. A fastener as set forth in claim 2, in which said retainer comprises a channel-shaped bearing bracket having side walls for guiding said strap when the same is received in said retainer, and said lever is U-shaped and has legs having free end portions pivoted in said bearing bracket and a crosspiece connecting said legs opposite to said free end portions and interengageable with said one series of teeth.

4. A fastener as set forth in claim 1, in which said lever is movable in engagement with said one series of teeth in said one sense to a position in which said lever engages said retainer and said strap at predetermined points when said strap has been received by said retainer, and said points in said position of said lever are spaced such a distance apart at right angles to the longitudinal direction of said strap that said position of said lever is an overcenter position.

5. A fastener as set forth in claim 1, which comprises lever-restraining means for cooperating with said lever and one of said fastener members to hold said lever in engagement with said one series of teeth.

6. A fastener as set forth in claim 1, in which said one series of teeth are carried by said retainer and disposed on the side thereof which faces said strap.

7. A fastener as set forth in claim 6, in which said retainer comprising a channel member having outwardly directed side walls which carry two of said series of teeth, said lever is connected to said strap and is U-shaped and has two legs which are arranged to protrude toward said teeth when said strap has been received by said retainer, and each of said legs has a detent extension which is engageable with one of said series of teeth.

8. A fastener as set forth in claim 7, in which said lever has a crosspiece which constitutes said extensions and said legs extend from said crosspiece and at their ends opposite to said crosspiece are pivoted to said strap.

9. A fastener as set forth in claim 8, in which said locking pawl is carried by said strap and consists of lateral projections which engage two of said series of teeth.

10. A fastener as set forth in claim 7, which comprises a U-shaped link, which is pivoted to said strap on a first pivotal axis and to said lever on a second pivotal axis spaced from said first axis in the longitudinal direction of said strap.

11. A fastener as set forth in claim 10, in which said strap has a free end carrying said locking pawl and said first pivotal axis is spaced from said free end.

12. A fastener as set forth in claim 10, which comprises a stop arranged to limit the pivotal movement of said lever relative to said link in said opposite sense.

13. A fastener as set forth in claim 1, in which said lever is pivotally movable in said opposite sense to an open position and a stop is provided, which is engageable by said lever to define said open position.

14. A fastener as set forth in claim 1, in which said lever is resiliently biased toward said open position.

15. A fastener as set forth in claim 14, in which said lever is U-shaped and has a cross-piece for engaging said teeth and resilient legs extending from said crosspiece and including an obtuse angle with each other.

16. A fastener as set forth in claim 15, in which said other fastener member is formed with slots and said legs engage said other fastener member is said slots.

17. A fastener as set forth in claim 15, in which said other fastener member has bevelled outside surfaces and said resilient legs of said lever engage said bevelled outside surfaces.

18. A fastener as set forth in claim 1, in which said strap has a stiffened free end portion which constitutes an actuating lever.

19. A fastener as set forth in claim 1, in which said tensioning lever has an engaging portion which is engageable with said strap and extends beyond said engaging portion to form an actuating lever.

20. A fastener as set forth in claim 1, in which said strap retainer is channel-shaped and has a crosspiece and side walls extending from said crosspiece, said locking pawl comprising a rib formed on said crosspiece and said side walls carry guiding projections, which are spaced from said crosspiece and face each other and are adapted to protrude over said strap when the same has been received by said retainer.

21. A fastener as set forth in claim 20, in which said side walls are resilient.

22. A fastener as set forth in claim 20, in which said guiding projections are offset from said rib in the longitudinal direction of said strap when the same has been received by said retainer.

23. A fastener as set forth in claim 20, in which said strap is formed in its side edges with grooves which conform in cross-section to said guiding projections and are inclined from a normal on said strap in a sense which is opposite to the inclination of said one series of teeth when said strap has been received by said retainer in said orientation.

24. A fastener as set forth in claim 23, in which said strap is formed with apertures adajcent to said strap-restraining means.

* * * * *